US007847691B2

(12) United States Patent
Jaeger et al.

(10) Patent No.: US 7,847,691 B2
(45) Date of Patent: Dec. 7, 2010

(54) SHIPPING CONTAINER SECURITY UNIT QUICK MOUNT DEVICE

(75) Inventors: Randy L. Jaeger, Windermere, FL (US); Dean M. Razee, Winchester, CA (US); Peter S. Lauenstein, La Canada, CA (US)

(73) Assignee: The Boeing Company, Chicago, IL (US)

( * ) Notice: Subject to any disclaimer, the term of this patent is extended or adjusted under 35 U.S.C. 154(b) by 926 days.

(21) Appl. No.: 11/240,994

(22) Filed: Sep. 30, 2005

(65) Prior Publication Data

US 2007/0075074 A1 Apr. 5, 2007

(51) Int. Cl.
*G08B 13/08* (2006.01)

(52) U.S. Cl. ..... 340/545.6; 340/545.1

(58) Field of Classification Search ..... 361/721, 361/679.02; 340/539.1, 546, 549, 545.1, 340/545.6, 562, 572.8, 545.4, 572.1; 324/658, 324/663, 671; 345/173, 174
See application file for complete search history.

(56) References Cited

U.S. PATENT DOCUMENTS 3,878,539 A * 4/1975 Gooding ..... 340/546
4,258,359 A * 3/1981 McLamb ..... 340/546
4,438,428 A * 3/1984 Ober et al. ..... 340/549
4,808,974 A * 2/1989 Cantley ..... 340/546
5,072,212 A * 12/1991 Sorenson ..... 340/546
5,341,123 A * 8/1994 Schuman et al. ..... 340/546
5,757,269 A * 5/1998 Roth et al. ..... 340/542
6,747,558 B1 * 6/2004 Thorne et al. ..... 340/551
7,315,246 B2 * 1/2008 Rajapakse et al. ..... 340/549
7,538,672 B2 * 5/2009 Lockyer et al. ..... 340/545.6
2004/0119588 A1 * 6/2004 Marks ..... 340/539.1
2005/0134457 A1 * 6/2005 Rajapakse et al. ..... 340/545.6
2005/0151643 A1 * 7/2005 Rajapakse et al. ..... 340/545.2

* cited by examiner

*Primary Examiner*—Jayprakash N Gandhi
*Assistant Examiner*—Adrian S Wilson
(74) *Attorney, Agent, or Firm*—Gates & Cooper LLP

(57) ABSTRACT

Mounting devices for attaching electronics equipment to a cargo container. An embodiment of the present invention comprises a mounting plate comprising a first portion for securing the electronics equipment to the mounting device, a second portion, coupled to the first portion at an edge of the first portion, at an approximate right angle to the first portion, and a third portion, coupled to the second portion at a second edge, wherein the third portion is approximately parallel to the first portion, wherein a length of the second portion being substantially similar to a width of a door of the cargo container, and the third portion is of sufficient length to retain the mounting device on the cargo container when the door of the cargo container is closed.

9 Claims, 4 Drawing Sheets

SHIPPING CONTAINER SECURITY UNIT QUICK MOUNT DEVICE

CROSS-REFERENCE TO RELATED APPLICATIONS

This application is related to U.S. patent application Ser. No. 11/241,346, entitled, "SHIPPING CONTAINER AIR VENT COVER ANTENNA HOUSING," by Randy L. Jaeger et al and filed same date herewith, the contents of which are incorporated by reference herein.

BACKGROUND OF THE INVENTION

1. Field of the Invention

The present invention relates generally to shipping containers, and in particular, to a shipping container security unit quick mount device.

2. Description of the Related Art

Shipping containers are used to transport goods all over the world. Many shipping containers are monitored to maintain a log of their whereabouts, as well as to monitor their estimated time of delivery to a given port or destination. There are over five million shipping containers in use today, and they typically transport over 500 billion dollars worth of goods into the United States on an annual basis.

In recent years, monitoring the flow of goods in these shipping containers has become more important. Since many goods are of higher value, the goods are under a larger threat of pilferage. Further, shipping containers could easily be tampered with to contain high explosives, or be used as a terrorist entry point into harbors and/or ports in the United States. The use of shipping containers for such purposes has been studied extensively by the Department of Homeland Security.

The current method of attaching tracking and/or monitoring devices is through the use of tape or other adhesives. The tape or adhesive material is used to affix the electronics boxes to the walls or ceiling of the container. The current method is very time consuming. Further, since this is typically done before the container is loaded and removed after the container is unloaded, additional loading time and unloading time is required for each container. Currently, using the tape and adhesive method, this attachment process for the electronic devices takes over an hour per container, to ensure that the electronics and associated wires that attach to an externally mounted antenna are not compromised by the container or the cargo within the shipping container.

The current method must also take into account that the cargo to be shipped in a given shipping container must not interfere with, damage, or otherwise contact the electronic devices. As such, the electronics devices and associated wires must be adhered to the container with excess tape and/or adhesive to ensure that any slight jarring of the container or of the electronic devices does not remove the electronic devices from their adhered positions.

As such, it can be seen that there is a need in the art for a device that makes installation of electronics devices on shipping containers less time consuming. It can also be seen that there is a need in the art for a device that makes installation of electronic devices on shipping containers easier and more efficient.

SUMMARY OF THE INVENTION

To minimize the limitations in the prior art, and to minimize other limitations that will become apparent upon reading and understanding the present specification, the present invention discloses a mounting device for attaching electronics equipment to a cargo container. A device in accordance with the present invention comprises a mounting plate comprising a first portion for securing the electronics equipment to the mounting device, a second portion, coupled to the first portion at an edge of the first portion, at an approximate right angle to the first portion, and a third portion, coupled to the second portion at a second edge, wherein the third portion is approximately parallel to the first portion, wherein a length of the second portion being substantially similar to a width of a door of the cargo container, and the third portion is of sufficient length to retain the mounting device on the cargo container when the door of the cargo container is closed.

Such an embodiment optionally includes being mounted to the door of the cargo container, the second portion further comprising a cutout for accepting a latch from the door through the cutout, to prevent removal of the mounting bracket from the cargo container, at least one dog ear, attached to the third portion, for assisting in coupling the mounting device to the cargo container, a plurality of captive attachment devices, coupled to the first portion, for attaching the electronics equipment to the mounting device, the captive attachment devices being placed in a plurality of configurations such that various types of electronics equipment are compatible with the mounting device, the electronics equipment being a security unit, the electronics equipment being a tracking unit, and can further comprise comprising a wire guide for protecting a wire running from the electronics equipment to an outside of the cargo container.

Another embodiment of the present invention comprises a bracket, comprising a top having a first edge and a second edge, the top having at least one mounting point and at least one attachment point, wherein the at least one mounting device is used to mount the bracket to the shipping container and the at least one attachment point is used to attach the bracket to an electronics package, a first side, coupled to a top along the first edge, the first side having at least a first access point to access the electronics package, and a second side, coupled to the top along the second edge, wherein the bracket accepts electronics packages of different types.

Such an embodiment optionally includes the mounting device being mounted to an interior portion of the cargo container, the second side further comprising at least a second access point to access the electronics package, the first access point accepting a cable for attachment to the electronics package, at least one captive attachment device, coupled to the top at the at least one mounting point in a respective fashion, for attaching the bracket to the cargo container, the at least one captive attachment device being placed in a plurality of configurations, the at least one attachment point being placed in a plurality of configurations, the electronics equipment being a security unit, and the electronics equipment being a tracking unit.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Door Hanger

Figure 1:
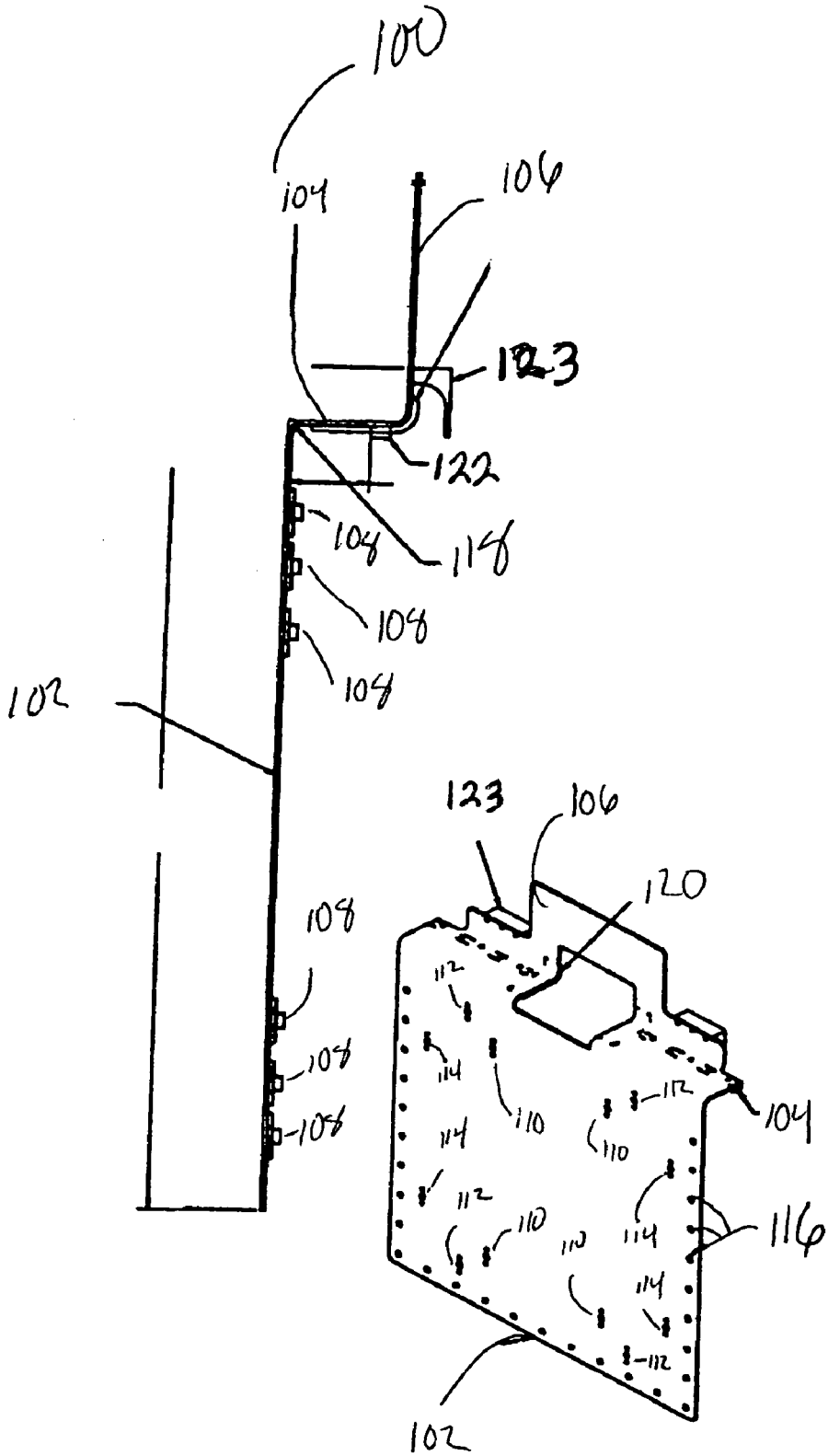
FIG. 1 illustrates a first embodiment of the present invention.

FIG. 1 illustrates side and perspective views of a first embodiment of the present invention.

FIG. 1 illustrates hanger 100 with first portion 102, second portion 104, and third portion 106. Typically, first portion 102, second portion 104, and third portion 106 are made from a single piece of material that is shaped as shown in FIG. 1, but can be made from several pieces of material without departing from the scope of the present invention. For example, first portion 102 may be made of a plastic or other non-conductive material if desired, to allow anything mounted on first portion 102 from being electrically connected to the cargo container hanger 100 is attached to.

First portion 102 is typically the mounting surface for electronics equipment or container tracking device. On first portion 102, typically on the side opposite where mounting of the electronics equipment takes place, captive mounting hardware 108 is held in place. Captive mounting hardware 108 is placed in locations on first portion 102 to ensure that standard electronics equipment mounting holes are easily engaged with hanger 100. As shown in the perspective view, patterns 110, 112, and 114 are created by strategically locating captive mounting hardware 108, which allows for quick mounting and dismounting of electronics equipment from hanger 100.

Further, generic mounting holes 116 can also be located on first portion 102. Mounting holes 116 can be threaded or non-threaded holes, which will either accept standard screw threads or allow for a screw to be threaded through the mounting hole 116 and engage threads on the electronics equipment to secure the electronics equipment to hanger 100. Although shown on the periphery of first portion 102, the generic mounting holes 116 can be placed anywhere on first portion 102 without departing from the scope of the present invention.

The size of first portion 102 is large enough to mount typical electronics equipment. Typically, this is approximately 10 inches across and 10 inches high, but can be other sizes if desired.

Second portion 104 is attached to first portion 102 at point 118. The angle of attachment between second portion 104 and first portion 102 is substantially a right angle. The length of second portion 104 is substantially equal to the width of a door on a cargo container.

Third portion 106 acts as a barrier to movement of the hanger 100 from the cargo container. As hanger 100 is placed on the cargo container, rather than bolting or hard-mounting hanger 100 on the cargo container, a cutout area 120 is placed over the bolt mechanism, also called the door mechanism, of the cargo container to hold the hanger 100 in place. As the cargo container door is closed, the first portion 102 is on the inside of the cargo container, the second portion 104 sits along the top of the door of the cargo container, and the third portion 106 sits on the outside of the cargo container, such that when the door of the cargo container is closed, and the door mechanism is engaged in a locked condition, the door mechanism prevents the hanger from moving side-to-side or up and down. Third portion 106 also can act as a mounting surface for external devices, e.g., antennas, if desired. The door mechanism maintains the relative position of the hanger 100 until it is desired to remove the hanger 100.

Wire guides 122 are typically attached to second portion 104 to properly guide any wires, such as antenna wires or the like, from the inside of the cargo container to the outside of the cargo container, e.g., to an antenna mounted outside of the cargo container or on third surface 106, without being damaged or severed by the doors of the cargo container. Hanging guides 123, also referred to as "dog ears," act as a stabilizing device to allow mounting and configuring of device 100 while the cargo container door is open. In essence, hanging guide 123 acts as a secondary hook to assist in hanging device 100 on the door of the cargo container prior to closing the door.

Although two wire guides 122 and hanging devices 123 are shown, any number of wire guides 122 and hanging devices 123 can be attached without departing from the scope of the present invention.

Interior Hanger

Figure 2:
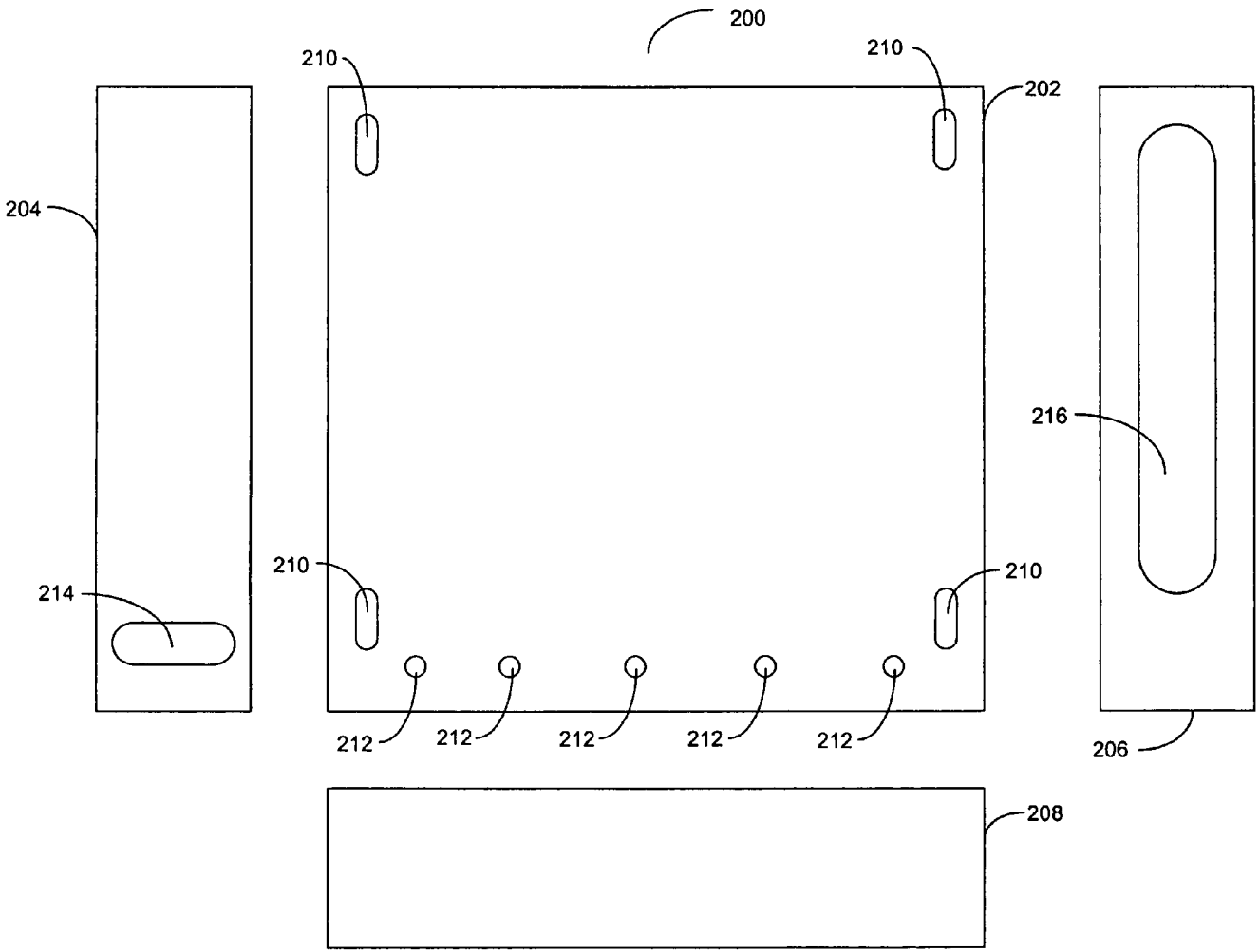
FIG. 2 illustrates a second embodiment of the present invention.

FIG. 2 illustrates a second embodiment of the present invention.

Bracket 200 is shown with top view 202, side views 204 and 206, and front view 208. Top view shows a preferred arrangement of mounting positions 210, and mounting holes 212. Mounting positions 210 typically contain captive mounting hardware, such as a floating nutplate, but can be through-holes, other captive mounting hardware, or located at other positions without departing from the scope of the present invention. Similarly, mounting holes 212 are typically through holes which can receive screws to attach bracket 200 to an electronics package, but can also be captive hardware, and can also be located at different positions than shown, without departing from the scope of the present invention. As with bracket 100, the mounting positions 210 and mounting holes 212 can be placed in various patterns or positions such that bracket 200 can be mounted to various types of cargo containers and receive various types of electronics equipment.

Side view 204 shows cutout 214, and side view 206 shows cutout 216. Cutouts 214 and 216 can be used to assist a person in mounting an electronics package to the bracket 200, as well as for additional mounting options for bracket 200. Further, cutouts 214 and 216 can provide an access port for cables, antenna leads, or other access to an electronics package mounted in bracket 200. Additionally, cutouts 214 and 216 can be of different sizes than those shown in FIG. 2 without departing from the scope of the present invention. Additional captive hardware and/or through-holes can be placed on the bracket 200 on the sides or the top without departing from the scope of the present invention.

Typically, bracket 200 is a single piece of material, which is typically aluminum, that is bent into a "u" shape. However, bracket 200 can be made from several pieces of material and welded or otherwise attached together at any location without departing from the scope of the present invention.

Several different electronics packages can be mounted in the bracket 200 by using different combinations of the mounting holes 212 and/or cutouts 214 to access and mount the electronics package.

Bracket 200 is designed for use on electronics packages that are to be mounted inside of a cargo container. Bracket 200 can be mounted to the roof or to the walls of the container, such that any electronic packages mounted to bracket 200 do not interfere with the loading or unloading of cargo from the container. Further, bracket 200 can be mounted in a position such that any antenna wires, power wires, or other interfaces to an electronics package mounted in bracket 200 also avoid interference with any cargo movement within the cargo container.

Figure 3:
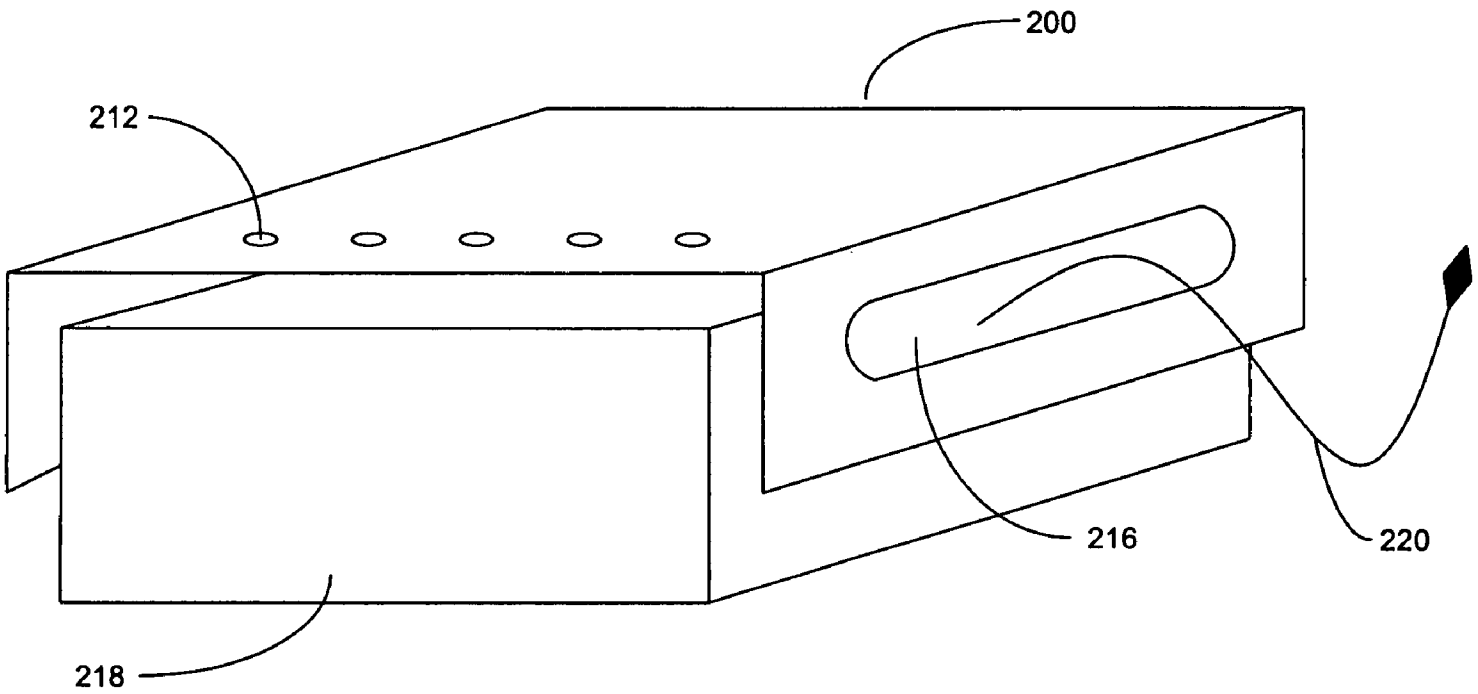
FIGS. 3 and 4 illustrate an electronics package mounted in the brackets of the present invention.
Figure 4:
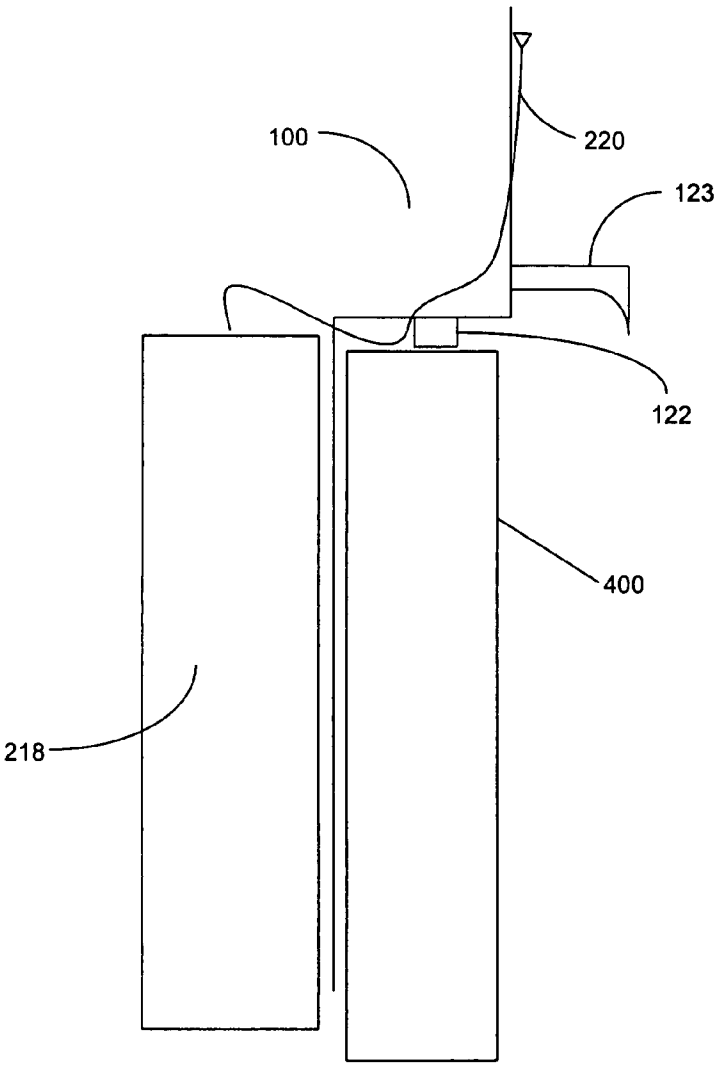

FIGS. 3 and 4 illustrate an electronics package mounted in the brackets of the present invention.

FIG. 3 shows bracket 200, with electronics package 218 mounted via mounting holes 212. Electronics package 218 can be a security device, tracking device, or other electronics package as desired. Electronics package 218 can optionally use cutout 216 to route cable 220. Cable 220 can be a cable, wire, or other access to electronics package, such as an antenna lead or power cable, which may best be routed through cutout 216 rather than some other access point, for ease of access or to protect cable 220.

FIG. 4 shows bracket 100, with electronics package 218 mounted. As with FIG. 3, electronics package 218 can be a security device, tracking device, or other electronics package as desired. Cable 220 is shown protected from damage by door 400 by being routed via wire guide 122, which can be performed as desired by the user. Wire guide 122 acts as a spacer to prevent door 400 from pinching or otherwise damaging cable 220 during door 400 opening and closing, as well as during container movement which could move door 400.

Although bracket 100 and bracket 200 are shown as a separate piece from electronics 218, it is within the scope of the present invention to make electronics 218 such that bracket 100 or bracket 200 is integral to electronics 218, such that a separate mounting of electronics 218 to bracket 200 or bracket 100 is not necessary, and thus electronics 218 would be able to hang on door 400 or be mounted to the cargo container directly.

Conclusion

This concludes the description of the preferred embodiment of the invention. In summary, embodiments of the invention provide mounting devices for attaching electronics equipment to a cargo container. An embodiment of the present invention comprises a mounting plate comprising a first portion for securing the electronics equipment to the mounting device, a second portion, coupled to the first portion at an edge of the first portion, at an approximate right angle to the first portion, and a third portion, coupled to the second portion at a second edge, wherein the third portion is approximately parallel to the first portion, wherein a length of the second portion being substantially similar to a width of a door of the cargo container, and the third portion is of sufficient length to retain the mounting device on the cargo container when the door of the cargo container is closed.

Such an embodiment optionally includes being mounted to the door of the cargo container, the second portion further comprising a cutout for accepting a latch from the door through the cutout, to prevent removal of the mounting bracket from the cargo container, at least one dog ear, attached to the third portion, for assisting in coupling the mounting device to the cargo container, a plurality of captive attachment devices, coupled to the first portion, for attaching the electronics equipment to the mounting device, the captive attachment devices being placed in a plurality of configurations such that various types of electronics equipment are compatible with the mounting device, the electronics equipment being a security unit, the electronics equipment being a tracking unit, and can further comprise comprising a wire guide for protecting a wire running from the electronics equipment to an outside of the cargo container.

Another embodiment of the present invention comprises a bracket, comprising a top having a first edge and a second edge, the top having at least one mounting point and at least one attachment point, wherein the at least one mounting device is used to mount the bracket to the shipping container and the at least one attachment point is used to attach the bracket to an electronics package, a first side, coupled to a top along the first edge, the first side having at least a first access point to access the electronics package, and a second side, coupled to the top along the second edge, wherein the bracket accepts electronics packages of different types.

Such an embodiment optionally includes the mounting device being mounted to an interior portion of the cargo container, the second side further comprising at least a second access point to access the electronics package, the first access point accepting a cable for attachment to the electronics package, at least one captive attachment device, coupled to the top at the at least one mounting point in a respective fashion, for attaching the bracket to the cargo container, the at least one captive attachment device being placed in a plurality of configurations, the at least one attachment point being placed in a plurality of configurations, the electronics equipment being a security unit, and the electronics equipment being a tracking unit.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto and the equivalents thereof.

What is claimed is:

1. A mounting device for attaching electronics equipment to a cargo container, comprising:

a mounting plate comprising a first portion of the mounting plate for securing the electronics equipment to the mounting device extending in a first direction;

a second portion of the mounting plate, coupled to the first portion at an edge of the first portion, at an approximate right angle to the first portion; and a third portion of the mounting plate, coupled to the second portion at a second, wherein the third portion is approximately parallel to the first portion such that the first portion extends away from the second portion in a first direction and the third portion extends away from the second portion in a second direction different from the first direction, wherein a length of the second portion being substantially similar to a thickness of a door of the cargo container and the second portion comprising a cutout for receiving a bolt mechanism of the cargo container through the cutout, and the third portion is of sufficient length to retain the mounting device on the cargo container when the door of the cargo container is closed.

2. The mounting device of claim 1, wherein the mounting device is mounted to the door of the cargo container.

3. The mounting device of claim 2, further comprising at least one dog ear attached to the third portion.

4. The mounting device of claim 3, further comprising a plurality of captive attachment devices, coupled to the first portion, for attaching the electronics equipment to the mounting device.

5. The mounting device of claim 4, wherein the captive attachment devices are placed in a plurality of configurations such that various types of electronics equipment are compatible with the mounting device.

6. The mounting device of claim 5, wherein the electronics equipment is a security unit.

7. The mounting device of claim 6, wherein the electronics equipment is a tracking unit.

8. The mounting device of claim 7, further comprising a wire guide, coupled to the second portion, for protecting a wire running from the electronics equipment to an outside of the cargo container.

9. A method of mounting electronics to a cargo container using the mounting device of claim 1.

* * * * *